US005693249A

United States Patent [19]

Szadkowski

[11] Patent Number: 5,693,249

[45] Date of Patent: Dec. 2, 1997

[54] DEVICE FOR SUPPLYING AND REPLACING POURING TUBES IN A CONTINUOUS CASTING PLANT

[75] Inventor: Stanislav Szadkowski, Marly, Switzerland

[73] Assignee: International Industrial Engineering S.A., Braine-L'Alleud, Belgium

[21] Appl. No.: 586,704

[22] PCT Filed: Jul. 20, 1994

[86] PCT No.: PCT/BE94/00045

§ 371 Date: Jan. 26, 1996

§ 102(e) Date: Jan. 26, 1996

[87] PCT Pub. No.: WO95/03906

PCT Pub. Date: Feb. 9, 1995

[30] Foreign Application Priority Data

Jul. 27, 1993 [BE] Belgium ..... 09300779

[51] Int. Cl.[6] ..... B22D 11/10; B22D 41/56

[52] U.S. Cl. ..... 222/590; 164/437; 222/606

[58] Field of Search ..... 164/459, 418, 164/488, 489, 437, 438; 222/590, 606, 607; 266/DIG. 1

[56] References Cited

U.S. PATENT DOCUMENTS

| | | | |
|---|---|---|---|
| 3,730,401 | 5/1973 | Bode, Jr. | 164/437 X |
| 4,669,528 | 6/1987 | Szadkowski | 164/437 |
| 4,693,401 | 9/1987 | Nishimura et al. | 222/607 |
| 5,173,199 | 12/1992 | Brückner et al. | 222/606 X |
| 5,180,536 | 1/1993 | Bruckner et al. | 222/606 X |
| 5,351,865 | 10/1994 | Szadkowski et al. | 222/607 |

FOREIGN PATENT DOCUMENTS

| | | | |
|---|---|---|---|
| 0 192 019 | 8/1986 | European Pat. Off. . | |
| 0 442 515 | 8/1991 | European Pat. Off. . | |
| 2027881 | 12/1971 | Germany | 164/437 |
| WO 92/00822 | 1/1992 | WIPO . | |
| WO 93/00191 | 1/1993 | WIPO . | |

*Primary Examiner*—J. Reed Batten, Jr.
*Attorney, Agent, or Firm*—Dennis T. Griggs

[57] ABSTRACT

A pouring tube in the ingot mold of a continuous casting plant for producing thin slabs is replaced by arranging an auxiliary plate (4) on guide rails (9) next to an insert plate (3) of a pouring tube (12) in its operative position (14). A replacement pouring tube (2) is placed next to the auxiliary plate (4) so that the plates (3, 4) form a perfectly planar surface with abutting edges.

5 Claims, 4 Drawing Sheets

DEVICE FOR SUPPLYING AND REPLACING POURING TUBES IN A CONTINUOUS CASTING PLANT

The present invention relates to a device for supplying and exchanging a pouring tube in a mould of a thin-slab continuous casting plant, comprising an upper reference plate applied against the bottom of the pouring vessel and guide rails which can transfer a thrust force upwards and can guide the sliding of the tube and of a replacement tube through the action of a cylinder, from an initial position towards an in-use position in the pouring axis and from the in-use position towards a disengagement position, so as to enable tubes to be exchanged without removing the pouring vessel.

Its main application is in the continuous production of thin slabs involved in the manufacture of flat products, such as heavy plate and hot-rolled and cold-rolled thin sheet.

The invention makes it possible to transfer the technology, introduced by European Patent No. 0 192 019, for the continuous casting of conventional slabs to the manufacture of thin slabs for the purpose of having uninterrupted pouring runs from several pouring ladles.

Continuous casting plants employing an ingot mould or mould having an elongated rectangular cross-section already exist. They allow production of slabs whose thickness is generally between 150 and 250 mm and whose width may be up to 2,700 mm.

In existing thin-slab continuous casting plants, an uninterrupted pouring run is achieved by using several pouring ladles in succession, but, in fact, continuity in the quality of the steel is broken. There is no interruption in the pouring run, but a momentary interruption in the extraction of the slab which inevitably leads to downgrading of the quality of the steel during an interval of time which may be as long as 2 to 3 minutes when changing the tundish.

This lapse of time is sufficient to cause a major section of the slab to be scrapped, due to external and/or internal junction marks in the solidified metal as well as surface flaws and internal contamination which are due to the interruption in the stable process of continuous casting.

The present invention aims to provide uninterrupted continuous casting for a long period, enabling several pouring ladles to be drained in succession with a flow rate which ensures that the slab is extracted at a rate such that the quality of the steel remains constant throughout the duration of casting. At any moment throughout the duration of casting, the rate of extraction of the slab remains greater than or at least equal to a critical rate, that is to say greater than the rate below which the slab becomes degraded in terms of quality.

This object is achieved by virtue of a pouring-tube-exchanging device of the type described in the first paragraph of the present document. In thin-slab continuous casting, it is proposed to give the pouring tube a flared and flattened shape, in particular at the lower end of the tubular body.

It is obvious that such a flattened tube is highly stressed by erosion because of the high laminar flow rate on a small thickness of the film and subject to obstructions due, for example, to freezing of the metal which flows away as a relatively thin layer.

According to one feature, the flared lower part of the body of the pouring tube projects widthwise from the attached moving plate.

The flattened shape of the submerged pouring tube makes it easier, over the entire width of the mould, to obtain a uniform flow imposed by the constancy of the rate and the thermal requirements.

The invention makes it possible to have a long run for continuously casting thin slabs, that is to say having an accentuated rectangular cross-section whose thickness is less than 100 mm. These thin slabs are the starting point for manufacturing flat products, in particular sheets rolled in continuous rolling mills.

This technology makes it possible to prevent surface oxidation of the slabs as a result of multiple heating of the sheets during the rolling.

The upper end of the pouring tube carries an attached plate having a perfectly plane upper face which forms an integral part of the pouring tube.

The presence of a flared and flattened skirt of the pouring tube does not affect the disposition of the guide rails or the operations to be carried out by pivoting in order to introduce a pouring tube from a horizontal initial position outside the mould to a vertical stand-by position inside the mould and for supplying a tube from a vertical stand-by position beside the tube in the pouring position towards the said pouring position.

The invention relates to a process for supplying and exchanging a pouring tube in a mould of a continuous casting plant, as described hereinabove and intended for the manufacture of thin slabs. In order to effect the tube change, a supply and exchange device similar to that described in the document EP-A-0 192 019 or WO 92/00822 is used and an auxiliary plate is arranged on the guide rails, beside the plate attached to the pouring tube in the in-use position, beside which auxiliary plate a replacement pouring tube is juxtaposed so that the said plates form a perfectly plane surface with contiguous edges.

According to one development of the invention, the auxiliary plate has the same outline as the guide rails and a longitudinal dimension at least twice the projection of the flared part of the body of each of the pouring tubes.

These features and details of the invention, as well as other characteristics, will appear during the following detailed description of one particular embodiment of the supply and exchange device, this embodiment being given by way of illustrative and non-limiting example and in which reference is made to the hereto-appended drawings.

In these drawings.

In these figures, the same reference notations designate identical or similar elements.

Figure 1:
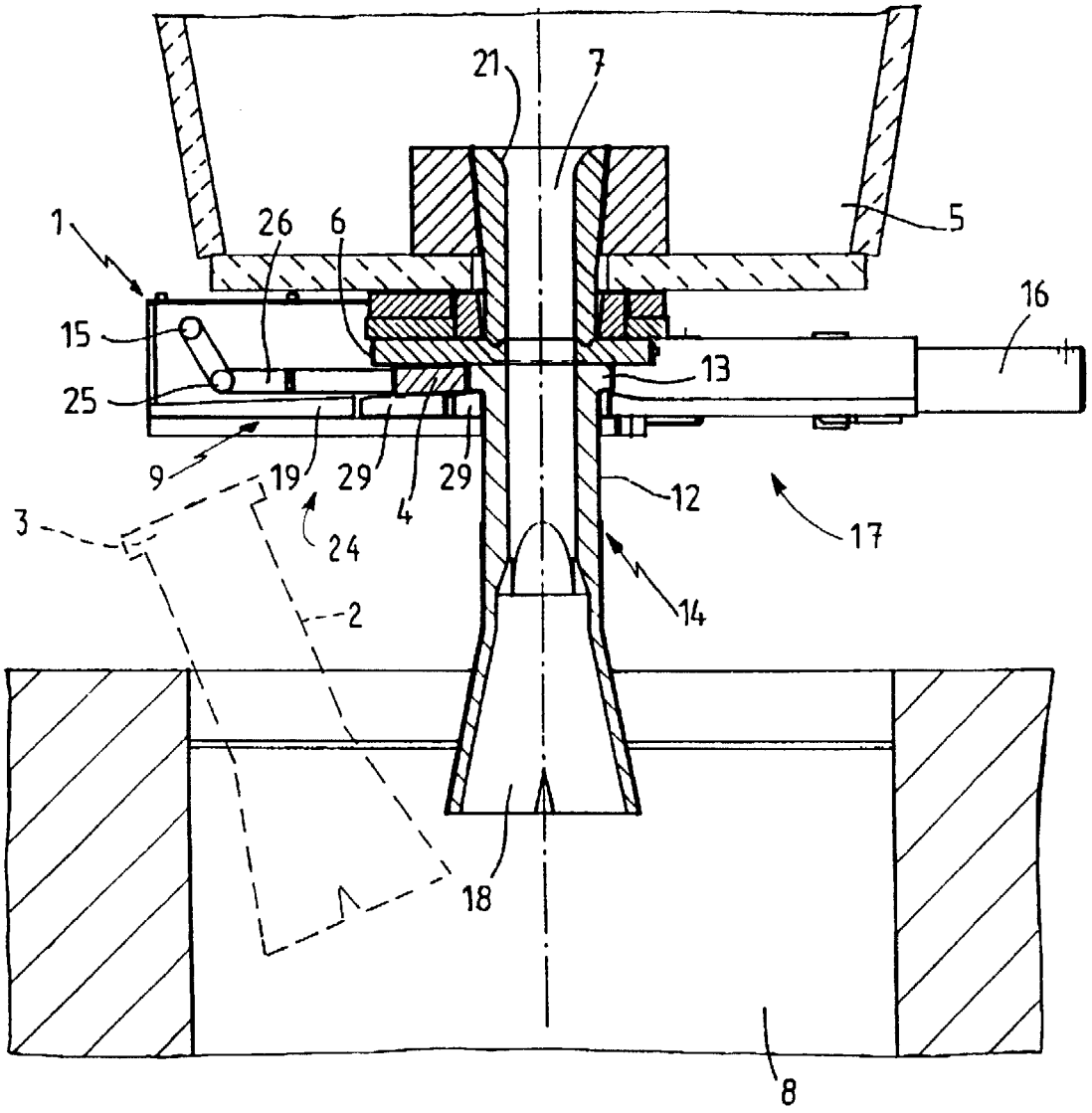
FIG. 1 is a longitudinal sectional view of a device for supplying and exchanging, according to the invention, a flared pouring tube arranged in the in-use position beneath a pouring vessel and of an auxiliary plate in the stand-by position.

FIG. 1 shows a pouring-tube supply and exchange device according to the invention, designated in its entirety by the reference number 1, shown beneath a pouring tundish 5 in the vicinity of the taphole 7.

In a mould 8 of a continuous casting plant intended for the manufacture of thin slabs, the pouring tubes 2, 12, in particular at the lower end of the tubular body, are given a flared and flattened shape 18 in the form of a butterfly.

Figure 2:
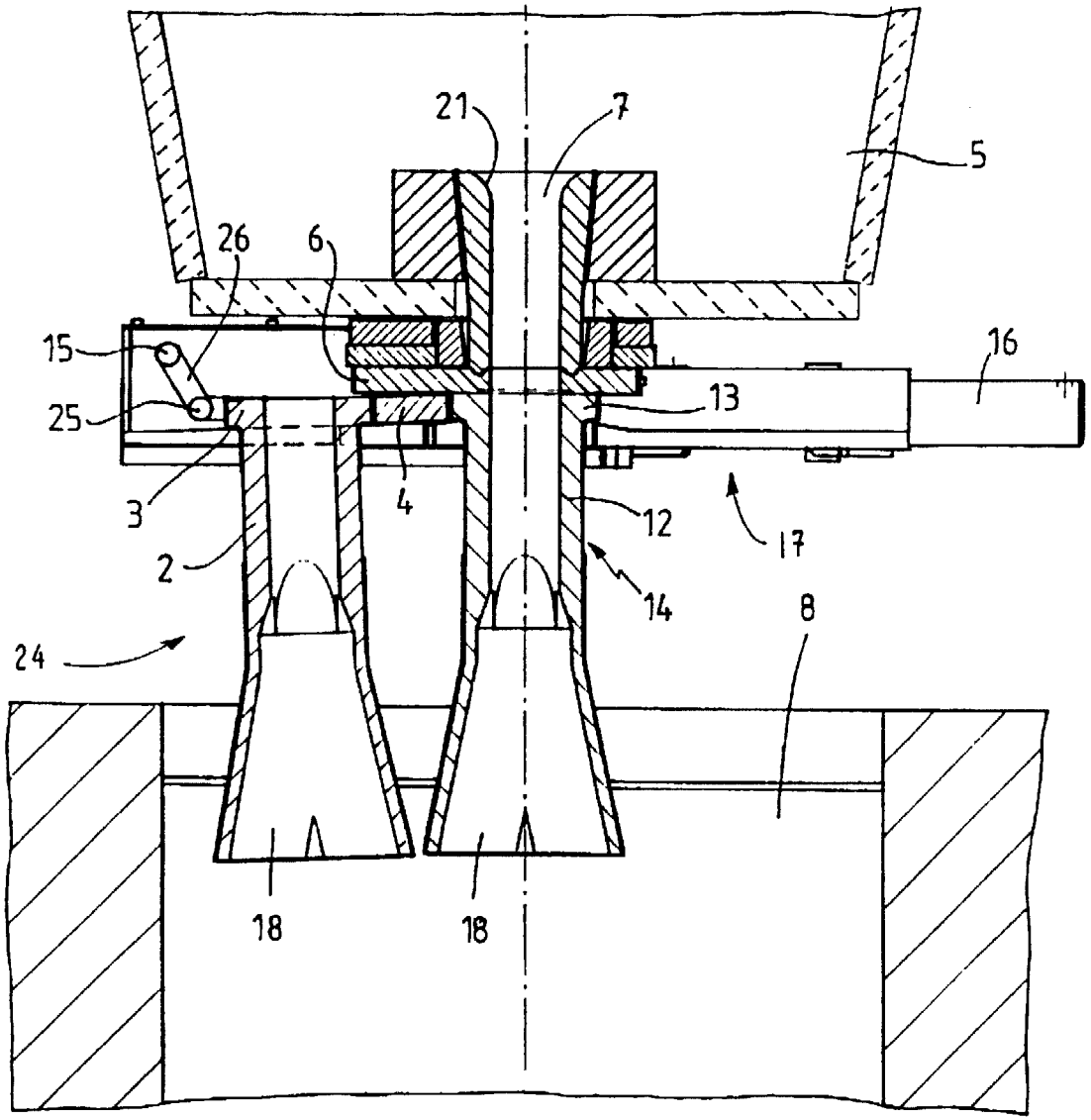
FIG. 2 is a section similar to that of FIG. 1 of the device according to the invention, equipped by having an auxiliary plate and a replacement pouring tube.
Figure 3:
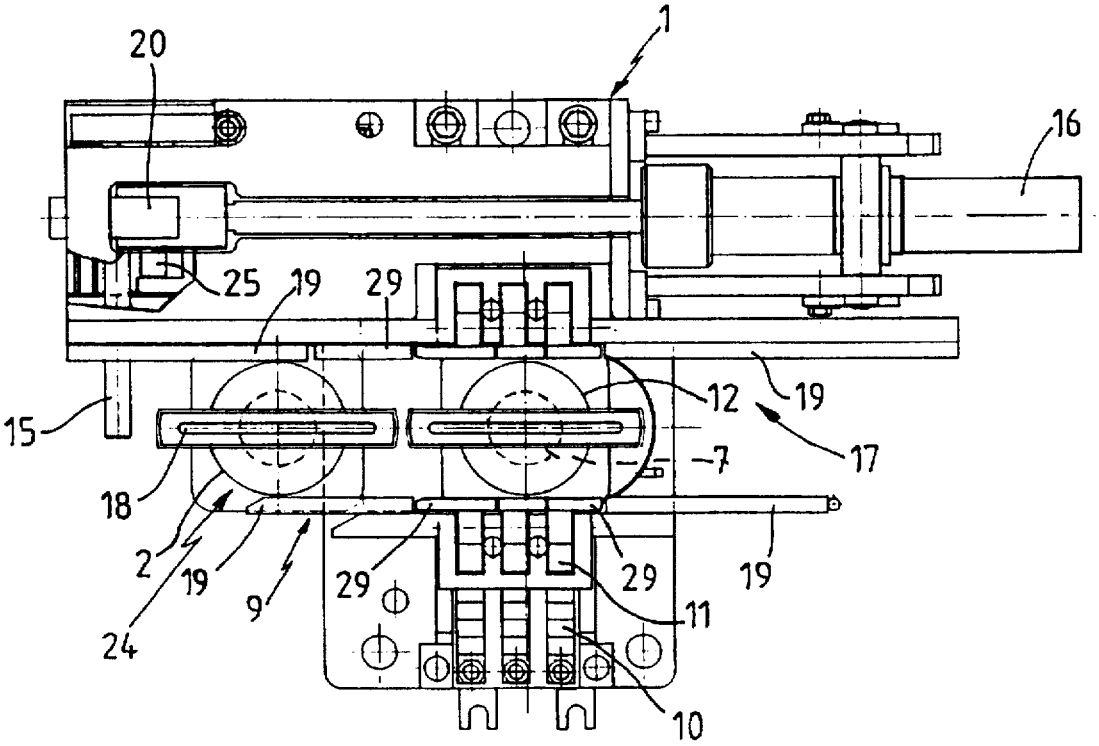
FIG. 3 is a plan view of the device shown in FIG. 2.
Figure 4:
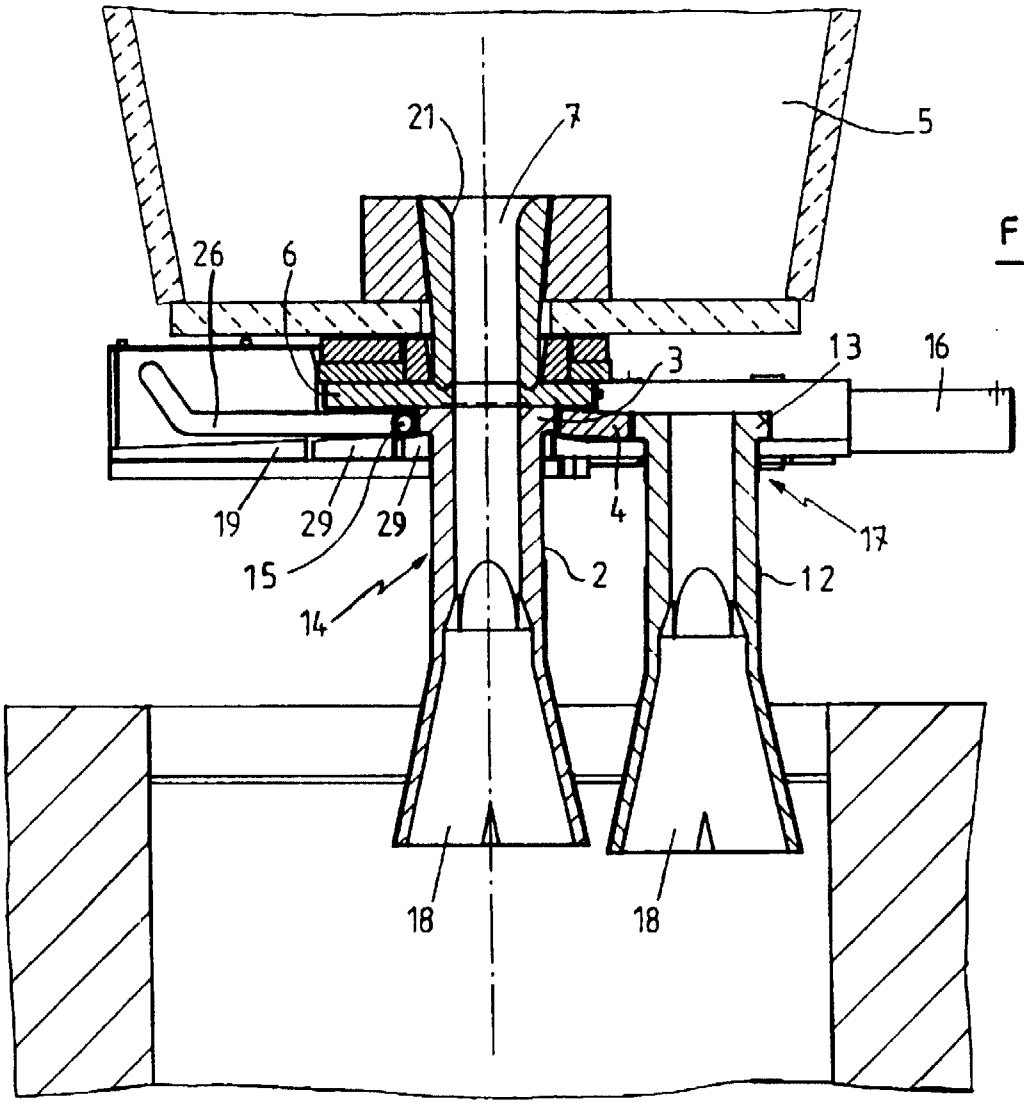
FIG. 4 is a sectional view similar to those of FIGS. 1 and 2 of the device according to the invention, in which a cylinder has effected the exchange of tubes.

The tundish 5 is generally fitted with a stopper rod, not shown. Occasionally it is also fitted with a sliding closure device. The supply and exchange device 1 is intended to supply a replacement pouring tube 2 attached to a plate 3, in the stand-by position 24 in the mould beside a pouring tube 12 in the in-use position 14 and to exchange the spent in-use tube 12 attached to a plate 13 in the in-use position 14 without removing the tundish (FIG. 2).

The pouring tubes 2, 12, juxtaposed with respect to a moving auxiliary plate 4, slide along an upper reference plate 6 applied beneath the pouring tundish 5, against an internal nozzle 21.

It is known that, to change the tube, the attached plate and the auxiliary plate 4 are moved by sliding along the reference plate 6.

The thickness of the auxiliary plate 4 is chosen to be equal to that of the attached plate 3, but a slight difference in thickness has no troublesome consequence because of the fact that, in the immediate vicinity of the taphole, this auxiliary plate 4 is pressed upwards. The edge of the auxiliary plate 4 serves as a sliding block in the device for supplying and loading tubes.

Two guide rails 9 have a travel which is inclined with respect to the reference plate 6.

In a manner known per se, as described in the document WO 92/00822, the guide rails 9 are divided into two sections, one being a fixed section 19, integral with a mounting frame intended to be mounted under the tundish, and the other a moveable section 29 and arranged between the two respective fixed rail sections each lying in the extension of the other.

The guide-rail sections 29 are each mounted at the end of a horizontal lever which can pivot about a bearing point fastened to the mounting frame. Each lever 11 is subjected to the action of a spring 10, which action, directed downwards, applies the moving guide-rail sections 29 upwards.

The force exerted by the moving guide-rail sections 29 on the pouring tubes 2 varies depending on the position of the said tubes along the guide rails and increases progressively as the replacement pouring tube 2 approaches the taphole 7 and decreases progressively as the spent tube moves away therefrom.

Progressive clamping of the abovementioned plate 3 of the replacement pouring tube 2 against the upper reference plate 6, and progressive unclamping of the moving plate 13 of the spent tube 12, is obtained, thereby allowing easy removal of the said spent tube in the disengagement position 17 at the end of the travel of the guide rails 9.

The linear displacement of the moving plates 3, 13 is provided by a retractable push rod 15 carried by a pneumatic cylinder 16, the head 20 being articulated about a pivot 25, so as to allow the push rod to be guided by a broken groove 26.

In each of the figures, the cylinder 16 is shown, although it returns to its initial position in which the push rod 15 allows, by virtue of its high position, free access to the stand-by position 24 for loading the pouring tubes onto the guide rails 9.

In one particular embodiment, a rocker arm ensures parallelism between the moving plate 3 and the upper reference plate 6 right from the start of the operation of supplying and loading the replacement pouring tube 2.

I claim:

1. Apparatus for supplying and replacing a pouring tube in a mould of a continuous casting plant having a pouring vessel for producing thin slabs, comprising:

a reference plate coupled to the pouring vessel;

guide rails disposed adjacent the pouring vessel for guiding a pouring tube from a standby position towards an operative position beneath the pouring vessel and for guiding the pouring tube from the operative position towards a disengagement position;

power means for moving an original pouring tube along the guide rails to the standby position and for moving a replacement pouring tube along the guide rails from the standby position to the operative position while displacing the original pouring tube from the operative position to the disengagement position; and, an auxiliary plate disposed for sliding movement in contact with the reference plate, said auxiliary plate being coupled in force transmitting relation between the replacement pouring tube and the original pouring tube.

2. Apparatus as defined in claim 1, characterized in that each pouring tube has a flared part and the auxiliary plate has the same outline as the guide rails and a longitudinal dimension, said longitudinal dimension being at least twice the projection of the flared part of each pouring tube.

3. Apparatus as defined in claim 2, characterized in that the flared part of the pouring tube is flattened in the form of a butterfly.

4. Apparatus as defined in claim 1 including an insert plate coupled to each pouring tube, respectively, characterized in that the auxiliary plate has a width equal to that of the insert plate.

5. Process for supplying and exchanging a worn pouring tube by a replacement pouring tube, each pouring tube including an insert plate disposed for sliding movement along guide-rails in a mould of a thin slab continuous casting plant, characterized by the steps:

moving the replacement pouring tube from an initial position towards an in-use casting position by pushing the worn pouring tube out of operative service from its casting position towards a disengagement position by an auxiliary plate which forms with the insert plates of said worn pouring tube and replacement pouring tube a substantially planar surface intersected by abutting edges of said insert plate.

* * * * *